United States Patent [19]

Wiese

[11] Patent Number: 4,782,973

[45] Date of Patent: Nov. 8, 1988

[54] CUSHION BOTTOM TANK

[75] Inventor: Delmar R. Wiese, Springfield, Mo.

[73] Assignee: Custom Metalcraft, Inc., Springfield, Mo.

[21] Appl. No.: 62,680

[22] Filed: Jun. 16, 1987

[51] Int. Cl.[4] ..... B61D 27/00

[52] U.S. Cl. ..... 220/68; 220/1.5; 220/5 A; 220/444; 220/465; 220/466

[58] Field of Search ..... 220/68, 1 C, 5 A, 444, 220/465, 466, 469, 1.5

[56] References Cited

U.S. PATENT DOCUMENTS

| | | | |
|---|---|---|---|
| 2,033,268 | 3/1936 | Widman | 220/68 X |
| 2,185,026 | 12/1939 | Goecke | 220/466 X |
| 2,336,885 | 12/1943 | Pepersack | 220/465 |
| 2,361,635 | 10/1944 | Koppel | 220/466 X |
| 2,887,251 | 5/1959 | Mackridge | 220/1.5 X |
| 2,916,182 | 12/1959 | Rollins et al. | 220/465 X |
| 4,010,863 | 3/1977 | Ebel | 220/1 C |
| 4,648,521 | 3/1987 | Thomas et al. | 220/5 A X |
| 4,673,102 | 6/1987 | Bullock, Jr. | 220/444 X |

*Primary Examiner*—Steven M. Pollard
*Attorney, Agent, or Firm*—Nies, Webner, Kurz & Bergert

[57] ABSTRACT

A liquid storage tank and flanged valve attachment for the tank are disclosed. The storage tank includes a double bottom wall, with the inner bottom wall formed to slope downwardly from all corners of the tank toward a discharge member. Such a downward slope is provided by forming a downwardly sloping channel from each corner of the tank toward the point of discharge, and with the planar surfaces of the upper wall between the channels being also sloped accordingly. Between the two bottom walls, a structural, insulating or vibration dampening material is provided so as to make the inner and outer bottom walls integral for superior strength and vibration resistance. A flanged discharge arrangement is provided for the discharge member in one embodiment. The flanged discharge includes a casting attached to the inner and outer bottom walls, and with holes for receiving bolts to secure a valve to the casting.

9 Claims, 2 Drawing Sheets

CUSHION BOTTOM TANK

BACKGROUND AND SUMMARY OF THE INVENTION

The present invention relates to a tank having special features which provide a reinforced bottom. More particularly, the present invention relates to a tank having a double wall construction in the tank bottom and in which structural, insulating and vibration dampening materials are employed between the two walls so as to be integral therewith, thus providing superior strength and vibration resistance. In a further embodiment of the invention, a discharge valve is mounted on the under side of the double wall tank by the use of a flanged casting construction.

Previous constructions of tanks and other containers having reinforced bottoms are described in the following U.S. Pat. Nos: 1,929,709 to Neely; 1,978,608 to Straty; 2,136,474 to Straty; 3,406,855 to McKechnie; 3,687,087 to Yurkoski et al.; and 4,557,406 to Olinger et al. Other tank constructions are described in German Pat. No. 1,220,784 and French Pat. No. 1,538,651.

By the present invention, there is provided an improved tank construction in which the tank bottom is fabricated with a double wall construction to provide superior strength to this area. The inner wall of the tank bottom is formed to slope from all sides toward the point of discharge for a self-draining bottom with the capability of complete discharge of the liquid product contained within the tank.

The discharge nipple in the tank bottom is of a material such as schedule 80 material for increased strength. The nipple is welded to both the inner and outer walls of the bottom at separate points for greatly increased strength and stability for supporting a valve and fittings as each application may require. A flanged valve attachment is also available in an alternative embodiment with a similar supporting feature.

Between the two walls of the tank bottom, various types of structural, insulating and vibration dampening materials may be provided. Each such material will add various levels of structural, insulating and vibration dampening effects and such materials together with the two walls will provide an integral construction for superior strength and vibration resistance.

By the present invention, damage to the inner tank bottom is minimized due to the protective outer tank bottom. The tank of the present invention can be fabricated from various materials to satisfy particular needs. The base dimensions and discharge point will be adapted as required for each particular application.

DESCRIPTION OF THE PREFERRED EMBODIMENTS

Figure 1:
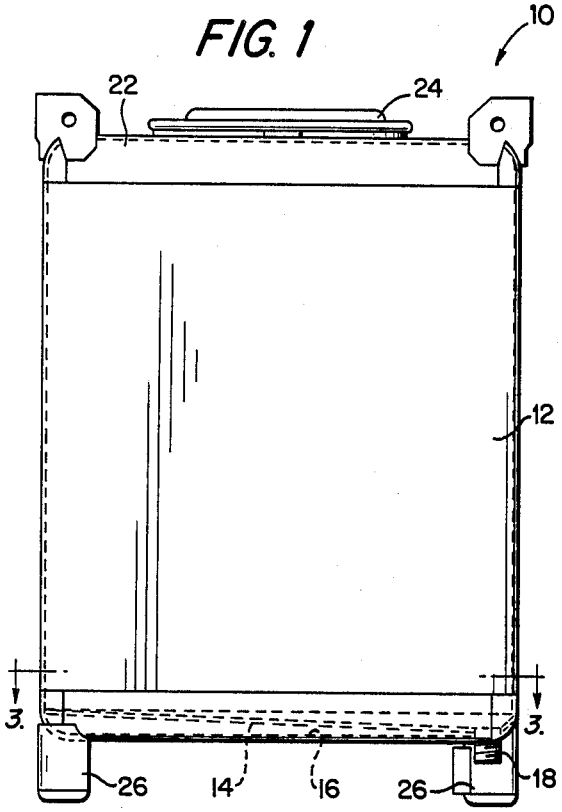
FIG. 1 is a front elevation of a tank construction in accordance with the present invention.
Figure 3:
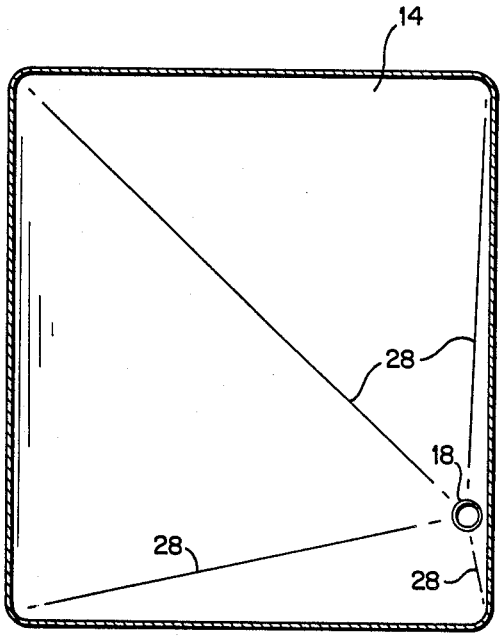
FIG. 3 is a sectional view taken along line 3—3 of FIG. 1.
Figure 2:
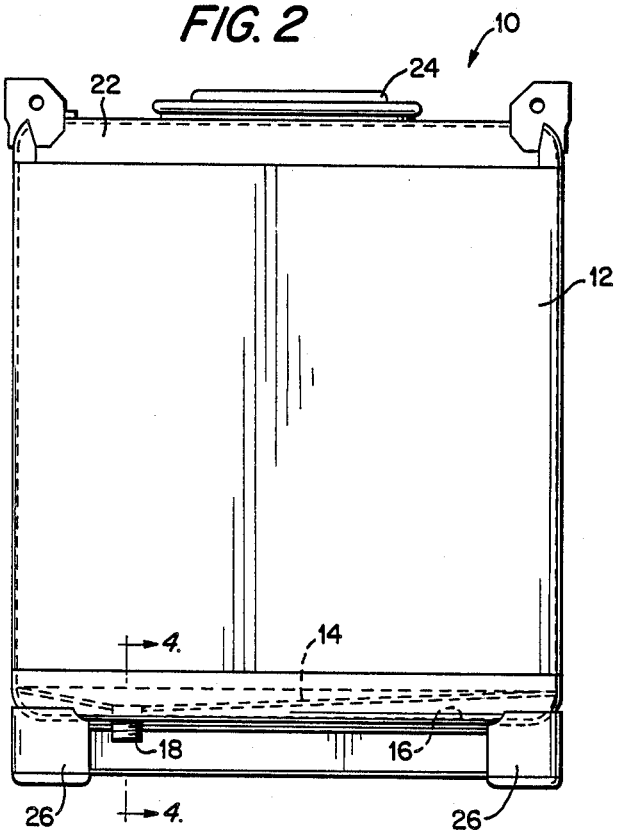
FIG. 2 is a side elevation of the tank of FIG. 1.
Figure 4:
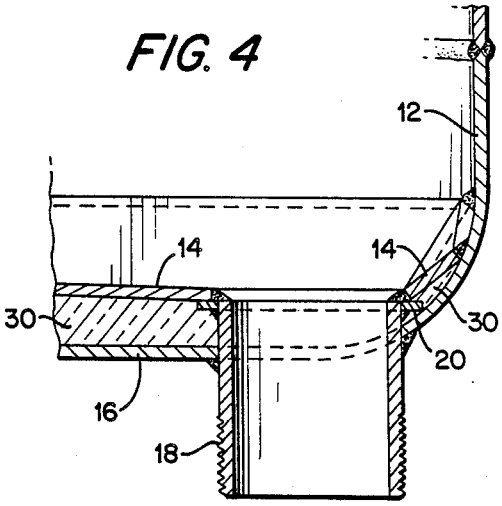
FIG. 4 is a sectional view taken along line 4—4 of FIG. 2.

In the embodiment of the present invention as shown in FIGS. 1 through 4, there is provided a tank 10 having side walls 12, and an inner 14 and outer 16 bottom wall. The tank outlet is in the form of a pipe nipple 18 which is welded to both the inner and outer bottom wall, as shown in FIG. 4, with a support ring 20 at the inner end of the nipple being welded to the outer surface of the inner bottom wall 14. A top wall 22 and closure plate 24 of a suitable type may be provided as desired. Four supporting legs 26 are located at the corners of the tank 10.

The inner bottom wall 14 is formed so as to slope downwardly toward the outlet pipe 18 from all corners of the tank 10, as shown in FIG. 3. Such a downward slope is provided by forming a downwardly sloping channel 28 from each corner of the tank 10 toward the outlet 18, and with the planar surfaces of the upper wall 14 between the channels 28 being also sloped accordingly.

A suitable material 30 is provided in the space or cavity between the inner 14 and outer 16 walls as shown in FIG. 4. In a preferred embodiment, urethane foam is employed between walls 14 and 16, with the foam having any of various viscosities and densities as required to provide high structural rigidity or insulation characteristics.

Examples of three basic types of urethane foams which may be employed include the following:

(1) Low density pour in place urethane foam—a density of about 2 pounds per cubic foot rigid urethane foam for insulation. This is a two component rigid urethane for low density general application and can be used for void filling and insulation.

(2) Froth foam system—a two component rigid urethane froth foam primarily for insulation. This foam has a uniform cell structure combined with good dimensional stability. The average density of this foam material is from about 1.9 to 2.3 pounds per cubic foot.

(3) Mista-froth foam system—a relatively light, low density foam having a density of about 1.45 pounds per cubic foot. This foam system provides a little more flexibility for applications as needed.

The inner 14 and outer 16 bottom walls or heads of the tank 10 may be constructed of a suitable material such as stainless steel or aluminum having an average nominal thickness of from about ⅛ inch to 3/16 inch. Such material may also be employed for the pipe outlet and support ring.

In an alternative embodiment, as shown in FIGS. 5 through 8, there is provided a flanged discharge arrangement 40 for the tank 10 of the present invention. Insulation or other materials are provided between the inner 42 and outer 44 bottom walls of this embodiment as in the case of the previous embodiment.

Figure 5:
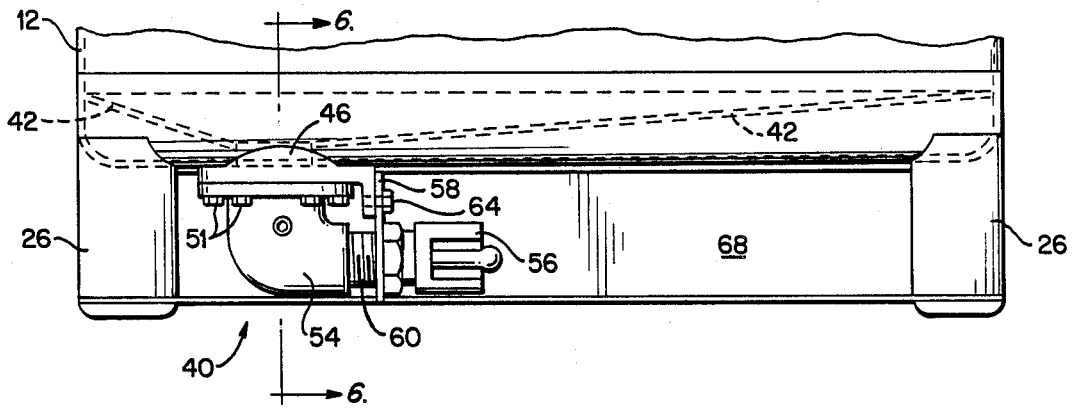
FIG. 5 is a partial front elevation of an alternative embodiment of the tank of the present invention.
Figure 6:
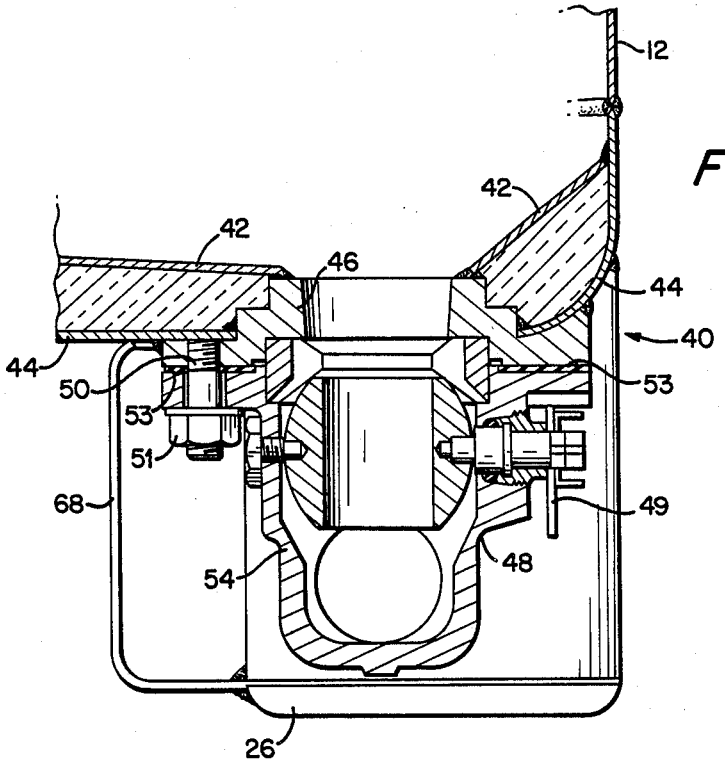
FIG. 6 is a sectional view taken along line 6—6 of FIG. 5.

The flanged discharge arrangement 40 includes a valve flange casting 46 which is welded to theinner 42 and outer 44 walls as shown in FIG. 6 to provide a means of mounting a discharge valve such as right angle ball valve 48 on the double wall tank 10. The casting 46 may be of a suitable material such as stainless steel. The ball valve 48 with control means 49 is secured to the casting 46 by means of bolts 50 and uts 51, the bolts 50 being threadedly received in holes 52 located at intervals around the circumference of the casting 46 as shown in detail in FIGS. 7 and 8. A suitable gasket 53 is mounted between the casting 46 and valve 48. The valve 48 includes an elbow portion 54 secured to the casting 46 as shown in FIGS. 5 and 6 and a quick connect unit 56 which is attached to the valve 48. A valve support bracket 58 supports the outer pipe nipple 60 of the valve 48, as shown in FIG. 5, with the upper end of the bracket 58 being secured to vertical rib 62 forming one end of the casting 46 by bolts 64 passing through holes 66 in the rib 62. A guard bracket 68 is welded at the bottom to the tank legs 26 and notched inwardly at the top around the valve flange 46 so as to fit snugly against the tank outer wall 44.

Figure 7:
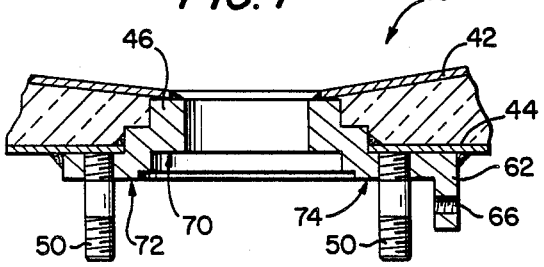
FIG. 7 is a sectional view of the flanged discharge casting employed in the present invention.
Figure 8:
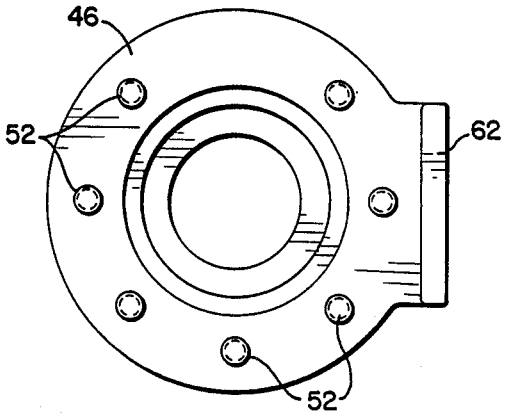
FIG. 8 is a bottom plan view of the flanged discharge shown in FIG. 7.

In FIG. 7 there is shown the valve seal surface 70 of the flanged casting 46 against which the valve 48 is seated. Also shown in FIG. 7 are the gasket faces 72, 74 of the flanged casting 46 against which the gasket 53 is seated.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A liquid storage tank comprising: a vessel having side walls, an inner bottom wall and an outer bottom wall, said inner bottom wall being formed with a discharge member which allows liquid to exit from the tank and with said inner bottom wall sloping towards said discharge member from all side walls, said discharge member being secured to both said inner and outer bottom walls, and with a layer of structural, insulating or vibration dampening material being provided between said inner and outer bottom walls so as to completely fill the space between said inner and outer bottom walls, thus making said inner and outer botom walls integral for superior strength and vibration resistance, said vessel having a generally square cross-section with four side walls which intersect to provide four corners for said tank, said inner bottom wall having a plurality of channels, with one of said channels sloping downwardly from each corner of said tank, said discharge member including a valve flange casting secured to both said inner bottom wall and said outer bottom wall, said flange casting having a valve seal surface, and with said flange casting having means located around the circumference thereof for receiving fasteners for fastening a valve to said flange casting.

2. The storage tank of claim 1 wherein said material is a urethane foam material.

3. The storage tank of claim 2 wherein said urethane foam is of low density in the range of about 1.4 to 2.3 lbs. per cubic foot.

4. The storage tank of claim 3 wherein said urethane foam is a low density pour in place foam in the form of a two component rigid urethane having a density of about 2 pounds per cubic foot.

5. The storage tank of claim 3 wherein said urethane foam is a two component rigid urethane froth foam having a uniform cell structure with a density of about 1.9 to 2.3 pounds per cubic foot.

6. The storage tank of claim 3 wherein said urethane foam is a low density mista-froth foam having a density of about 1.45 pounds per cubic foot.

7. The flanged discharge construction of claim 1 wherein said means for receiving fasteners includes a plurality of holes for threadedly receiving bolt means.

8. The flanged discharge construction of claim 1 further including a rib which extends from said flange casting in a direction generally perpendicular to said inner and outer bottom wall.

9. The flanged discharge construction of claim 8 further including a valve support bracket releasably secured to said rib.

* * * * *